US010774450B2

(12) United States Patent
Zeng et al.

(10) Patent No.: US 10,774,450 B2
(45) Date of Patent: Sep. 15, 2020

(54) METHOD TO MASSIVELY MANUFACTURE CARBON FIBERS THROUGH GRAPHENE COMPOSITES AND THE USE THEREOF

(71) Applicants: Tingying Zeng, Woburn, MA (US); Kevin Zeng Qi, Woburn, MA (US)

(72) Inventors: Tingying Zeng, Woburn, MA (US); Kevin Zeng Qi, Woburn, MA (US)

( * ) Notice: Subject to any disclaimer, the term of this patent is extended or adjusted under 35 U.S.C. 154(b) by 166 days.

(21) Appl. No.: 15/441,972

(22) Filed: Feb. 24, 2017

(65) Prior Publication Data

US 2017/0241049 A1 Aug. 24, 2017

Related U.S. Application Data

(60) Provisional application No. 62/299,054, filed on Feb. 24, 2016.

(51) Int. Cl.

| | |
|---|---|
| ***D01F 9/26*** | (2006.01) |
| ***D01F 9/14*** | (2006.01) |
| ***D01F 1/10*** | (2006.01) |
| ***D01F 9/16*** | (2006.01) |
| *D01F 9/22* | (2006.01) |
| *D01D 5/18* | (2006.01) |
| *D01D 5/00* | (2006.01) |

(52) U.S. Cl.

CPC ..... *D01F 9/26* (2013.01); *D01F 1/10* (2013.01); *D01F 9/14* (2013.01); *D01F 9/16* (2013.01); *D01D 5/0007* (2013.01); *D01D 5/18* (2013.01); *D01F 9/22* (2013.01); *D10B 2101/12* (2013.01)

(58) Field of Classification Search

CPC ..... D01F 9/14; D01F 9/26

See application file for complete search history.

(56) References Cited

U.S. PATENT DOCUMENTS

| | | | | |
|---|---|---|---|---|
| 3,652,221 | A | 3/1972 | Sloka | |
| 5,495,979 | A | 3/1996 | Sastri | |
| 5,705,269 | A * | 1/1998 | Pimenov | A61L 2/16 428/375 |
| 5,709,774 | A * | 1/1998 | Naieni | A61L 15/28 162/100 |
| 7,297,368 | B2 | 11/2007 | Williams | |
| 8,808,597 | B2 | 8/2014 | Wat | |

(Continued)

FOREIGN PATENT DOCUMENTS

| | | | |
|---|---|---|---|
| CN | 102588684 | A * | 7/2012 |
| CN | 102588684 | A | 7/2012 |

(Continued)

OTHER PUBLICATIONS

CN 102588684, machine translation, 2015. (Year: 2015).*
WO2015097047, machine translation, 2015. (Year: 2015).*

*Primary Examiner* — Robert A Vetere
(74) *Attorney, Agent, or Firm* — Lambert Shortell & Connaughton; Gary E. Lambert; David J. Connaughton, Jr.

(57) ABSTRACT

This invention innovates a low cost method to synthesize carbon fibers through graphene composites, which are fabricated through chemical treatment of graphite. This invention also is related to the applications of thereof carbon fibers in different fields. Several examples of such fields would be to use carbon fibers to manufacture carbon fiber tubes, pipes or risers, or car/airplane/computer parts, bicycles, and sports supplies and many additional applications.

14 Claims, 13 Drawing Sheets

(56) References Cited

U.S. PATENT DOCUMENTS

| | | | | |
|---|---|---|---|---|
| 2001/0001687 | A1* | 5/2001 | Pokorzynski | B29C 44/1209 428/318.6 |
| 2011/0268647 | A1* | 11/2011 | Ivanovici | B01J 21/08 423/448 |
| 2014/0265038 | A1* | 9/2014 | Naskar | D01F 9/14 264/405 |
| 2015/0099185 | A1* | 4/2015 | Joo | D01D 5/003 429/231.8 |
| 2016/0145772 | A1* | 5/2016 | Yoon | D01F 1/09 252/511 |

FOREIGN PATENT DOCUMENTS

| | | | | |
|---|---|---|---|---|
| WO | 2014037724 | | 3/2014 | |
| WO | 2015097047 | | 7/2015 | |
| WO | WO-2015097047 | A1 * | 7/2015 | D01F 1/10 |

* cited by examiner

METHOD TO MASSIVELY MANUFACTURE CARBON FIBERS THROUGH GRAPHENE COMPOSITES AND THE USE THEREOF

FIELD OF THE INVENTION

The present invention is related to a method to manufacture carbon fibers through graphene composites and the use thereof for their different applications by either solution method or melting-method.

BACKGROUND

Carbon fibers normally are made from carbon-rich polymers such as polyacrylonitrile (PAN), which are currently very expensive to produce, because it is synthesized from petroleum products through the oil-refining manufacturing process. There is need to overcome the significant pollution, high energy-demand, and time-consumption problems that are factors in the current production methods.

Carbon fibers can also be obtained from natural materials such celluloses, but the resulting yield of carbon fiber from celluloses is low. Carbon fiber enhanced composites have been developed for different applications, such as enhanced metal composite, ceramics, and polymer composites. The entire manufacturing process either needs extreme high temperature annealing or high cost raw materials. In addition, exploring carbon fiber's potential in new applications for energy-saving and anti-corrosion are important to our society. The current state of the art is focused oil-refining pipes, less-weight parts of electrical vehicles, airplanes, shapes in the oceans, and wind-power turbines, plus ocean energy applications. This invention targets those problems above.

SUMMARY OF THE INVENTION

The present invention uses natural graphene obtained from graphite as major carbon materials, with the templating of polymers such as cellulose to synthesize carbon nanofibers. The present invention utilizes nanomaterials such as nano powder of metal oxides or metal nanowires, and nano-cellulose along with graphene to form composite nanofibers which may then be treated by pyrolysis and/or annealing in inert/reduction environment. This results in high quality composites, with significantly lower cost throughout the entire process. The present invention innovates on the formation of large amount of metal composites and functional nanofibers with proper metal oxide flakes joined for unique applications. The components of the present invention may also produce a number of new carbon nanofiber composites for the creation and enhancement of, for example, anti-corrosion pipes and oil-refining pipes and platforms, as well as for enhanced high mechanical properties' body parts for vehicles and more. This invention represents an opportunity to provide energy savings, greener chemical process manufacturing, and lower the cost for electrical vehicles, parts of airplanes, as well as ships in the ocean.

The present invention uses one step to form high quality carbon nanofibers through the use of nanomaterials and their combinations.

One purpose of the invention is to provide a method to produce carbon fiber of enhanced quality with low cost and green chemical process.

Another purpose of the invention is to provide large amounts of carbon composite nanofibers for new field applications.

A further purpose of the invention is to allow for carbon fiber manufacturing which does not have as much waste and pollution released to the environment as current methods.

Another purpose of the invention is to significantly decrease the required manufacturing time to produce carbon fiber.

A further purpose of the invention is to decrease the requirements of equipment for the manufacture of carbon fiber.

Another purpose of the invention is to produce carbon fibers that may be created with the addition of other additive elements such as the additives listed below with regard to step 7, which can be used to create products which have a broad range of unique properties, such as thermo-conductivity, electric conductivity, resistance to corrosion, and many other properties that will be able to be used to improve electronics, energy efficiency, lower environmental impact, and increased product lifespan. For example, materials of the present invention may be used for the replacing of current all kinds of corrosion problems pipes, including our drinking-water pipes for better quality of drinking water for human and animals.

Another purpose of the invention is to provide large amounts of nanostructured metal/metal oxide carbon fiber with enhanced functional materials, such as those additives listed below, for multifunctionally unique materials applications.

The aforementioned goals are achieved by the present method using natural graphite and polymers such as nano celluloses as templating raw materials.

One embodiment of the present invention may include the following steps:

1) Graphene oxide (hereinafter "GO") is used as graphene material to start this process. Disperse the GO powder into solvent with the assistant of surfactants (or the components may be melt-formed), and add a small amount of polymers into the solution under stirring to obtain the uniform viscosity mixture for fiber production. In one embodiment, the polymers may be low-melt polymers, such as polymers having a melting point of less than 250° C.
2) Next the addition of a small amount of nano cellulose fibers as templates which lead to formation of a large amount of carbon fibers. The resulting fibers show thermal-insulating, fire-retardant and anisotropic properties. The fibers exhibit a feature of higher mechanical strength and thermal/electrical conductivities in the axial direction than in the radial direction.
3) Next process fibers using any fiber manufacturing methods, including but not limited to wet-drawing plus hot air heating, or drying spinning, melt-spinning or solution spinning by a spinning machine such as a cotton-candy style machine, or electrical spinning methods directly onto a substrate or a roll-to-roll collector or a drum collector, or any plate substrates as needs.
4) Then pre-heat the fibers at a temperature condition of about 100° C. in air, then to 300° C. for pre-carbonization.
5) Next as an optional step of the method the fibers can be further refined under inert gas condition, such as nitrogen, or argon, increase temperature to above 500° C. for pyrolysis of cellulose and create chemical bonding cross-links of GO with cellulose-formed graphene layers.
6) Next as an optional step of the method the fibers can be further refined in argon-hydrogen environment, anneal the fibers to above 800° C., and then to 1500° C. above for a few hours to ensure the perfection of crystallization of the graphitic carbon fibers.

7) The fibers may be further improved to enhance the graphene layer formation, or to achieve expected new properties, certain additives such as organic acid salts, or nanoparticles or nanowires of metal oxide, examples are not limited such as CuO, NiO, $ZrO_2$, $Fe_3O_4$, $Fe_2O_3$, $Co_2O_3$, MgO, $MnO_2$, ZnO, $TiO_2$, $Al_2O_3$, $SiO_2$, AgO, $SnO_2$, $Mo_2O_3$, $WO_3$, $Cr_2O_3$, trace lanthanum hafnate ($La_2Hf_2O_7$), $IrO_2$, and metal nanoparticles or nanowires, such as Al, Mg, Ag, Au, Cu, Ni, Co, Zn, Fe, Sn, Ti, Cr, W, Mo, Pt, and Si nanowires, and all of their combinations may be used to mix with GO, proper polymer, and cellulose to form the mixed suspension before fiber formation.

High carbon contented polymers are preferred, but not required. For example, polymers may include polyacrylonitrile (PAN), polystyrene, components found in asphalt, epoxy, polycarbonate, and any kinds of celluloses, polyvinyl alcohol (PVA), polyurethane, polyvinyl chloride (PVC), polyethylene (PE), and polyethylene glycol, nylon, polydimethylsiloxane, polyacrylamide, and the like.

Potential solvents may include, but are not limited to water, alcohols, acetone, ketones, dimethyl formamide (DMF), ethylene glycol (EG), DMSO, and their co-solvents.

Based on the processing temperature and additives, different mechanical properties of carbon fibers such as high tensile strength and elastic modulus similar to steel or much better than steel, and their composite nanofibers can be achieved. Excellent mechanical properties such as strength, tensile, young's modules, and elastic properties, as well as thermal and electrical conductivities plus microwave shielding anti-radiation, anti-electrical properties can be realized by optimizing the chemical components and their ratios plus the heat treatment temperature.

In one embodiment, the obtained carbon fibers could have nanostructures of graphene-cellulose-formed carbon fibers, or have the structures of graphene-metal oxide or graphene-metal nanowires composite nanofibers. The carbon fibers could be core-shell, or flakes-stacking formed ribbons fibers.

Applications of the present invention's method to form different products can be modified based on the specific needs of the manufacturer. The present invention's method is very flexible and allows for the creation of carbon fibers for different applications, including pipes for water delivery to replace current PVC pipes, and to substitute currently headache corrosion oil pipes in petroleum field, such as in the ocean. In a preferred embodiment, the method and exact chemical composition can be altered to allow for a solution to avoid the light weight locating problem in sea water, the carbon fiber pipes can be wrapped with concrete layers that have special components of cements powders and form solid outer layers around the carbon fiber pipes in the sea. The concrete powders react with sea water to fix the wrapping with excellent durability. This can avoid the corrosion problems for pipes in petroleum plants and fields. In a preferred embodiment this method allows for similar variations in the chemical process that is expandable to water pipes and chemical plant pipes for strong acid or base or any liquid chemicals transportation.

Application of this invention can bring about novel carbon fiber materials for the manufacturing of light weight parts for vehicles or space vehicles, which can advance the electric vehicles' manufacturing in the society, or increase economy and efficiency of traditional vehicles. Further application of this invention can produce new electronics designed in a durable way with improved heat dissipation. The as-prepared carbon fiber composites may be used for laptop keyboards and covers to enhance durability, and can be used on electronics to shield electromagnetic radiation and microwaves, can be used to make products that provide shielding such as clothes, windows, etc. The method and the resulting product have a multitude of applications which are anticipated to be developed over the next several years.

Anticipated claims will include all the procedures through polymers and graphene oxides and additives, fiber components, structures, and the final applications.

BRIEF DESCRIPTION OF THE DRAWINGS

The utility method shall be hereby described in detail in the description with reference to the attached drawings, in which.

DETAILED DESCRIPTION OF THE PREFERRED EMBODIMENTS

The present invention may be embodied in various forms and the details of the preferred embodiments of the present invention will be described in the subsequent content with reference to the accompanying drawings. The drawings show and depict only the preferred embodiments of the invention and shall not be considered as limitations to the scope of the present invention. Modifications of the shape of the present invention shall too be considered to be within the spirit of the present invention.

Figure 1:
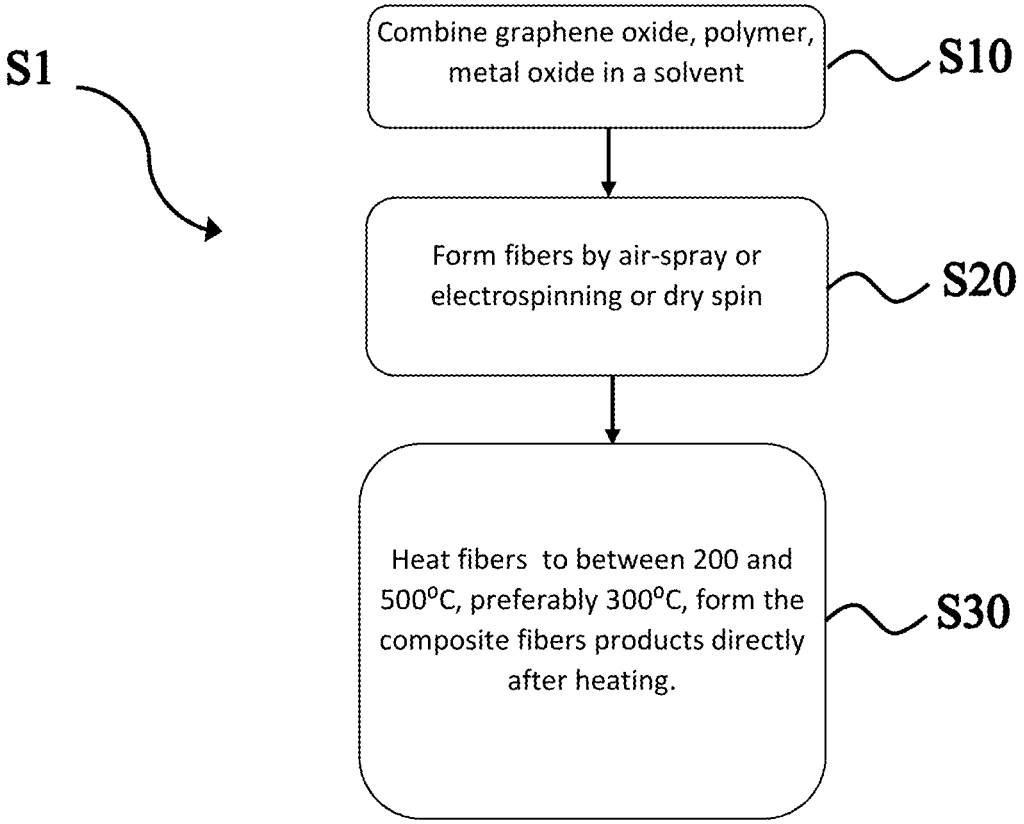
FIG. 1 is a flowchart showing a method of manufacturing graphene carbon fiber according to the present invention.

FIG. 1 shows an embodiment of an operational flowchart of the method of manufacturing graphene into carbon fiber according to the present invention. As shown in FIG. 1, the method of the present invention generally comprises the steps of mixing graphene oxide S10 with other components in a solvent, or melt formed compound, forming the fibers via air-spray or electrospinning, dry spinning, or the like S20, and applying a heat treatment between 200° C. to 500°

C. S30. By altering the heat treatment applied, the qualities of the resulting carbon fiber can be manipulated and enhanced. In a preferred embodiment of the present invention the heating process heats the fibers to 300° C. in air S30. In one embodiment, this heating may be performed for approximately 150 to 250 minutes, although this timing may vary depending on embodiment.

Figure 2:
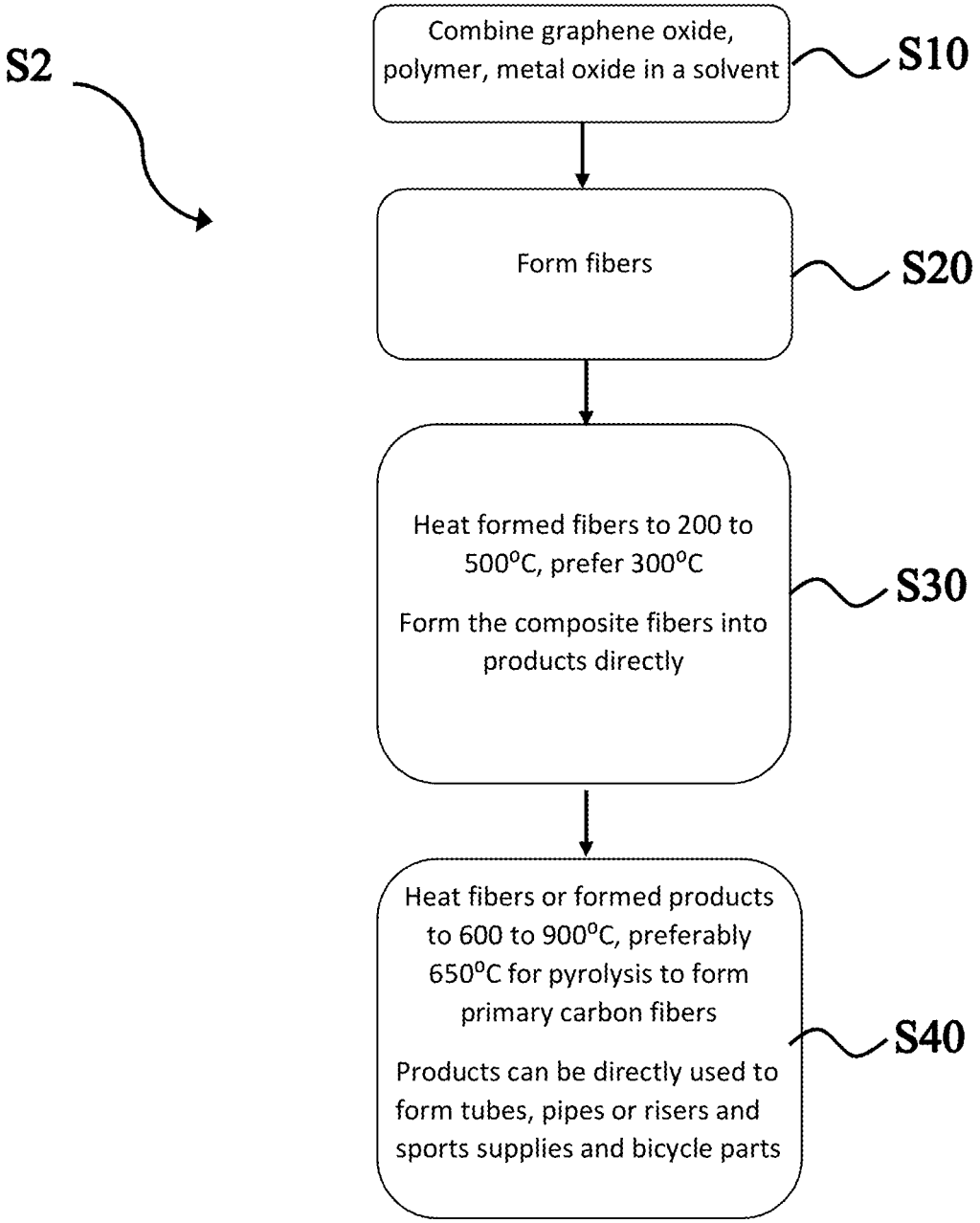
FIG. 2 is a flowchart showing another method of manufacturing graphene carbon fiber according to the present invention.

FIG. 2 shows another embodiment of an operational flowchart of the method of manufacturing graphene into carbon fiber according to the present invention. As shown in FIG. 2, the method of the present invention generally comprises the steps of mixing graphene oxide S10 with other components, forming the fibers via air-spray or electrospinning, dry spinning, or the like S20, applying a heat treatment between 200° C. to 500° C. S30, and applying a further heat treatment between 600 to 900° C. for pyrolysis to form primary carbon fibers S40. In a preferred embodiment of the present invention the heating process heats the fibers up to 300° C. in air S30 after which the fibers under inert gas condition, such as nitrogen, or argon, increase temperature to 650° C. for pyrolysis of cellulose and to create chemical bonding crosslinks of GO with cellulose-formed graphene layers S40.

Figure 3:
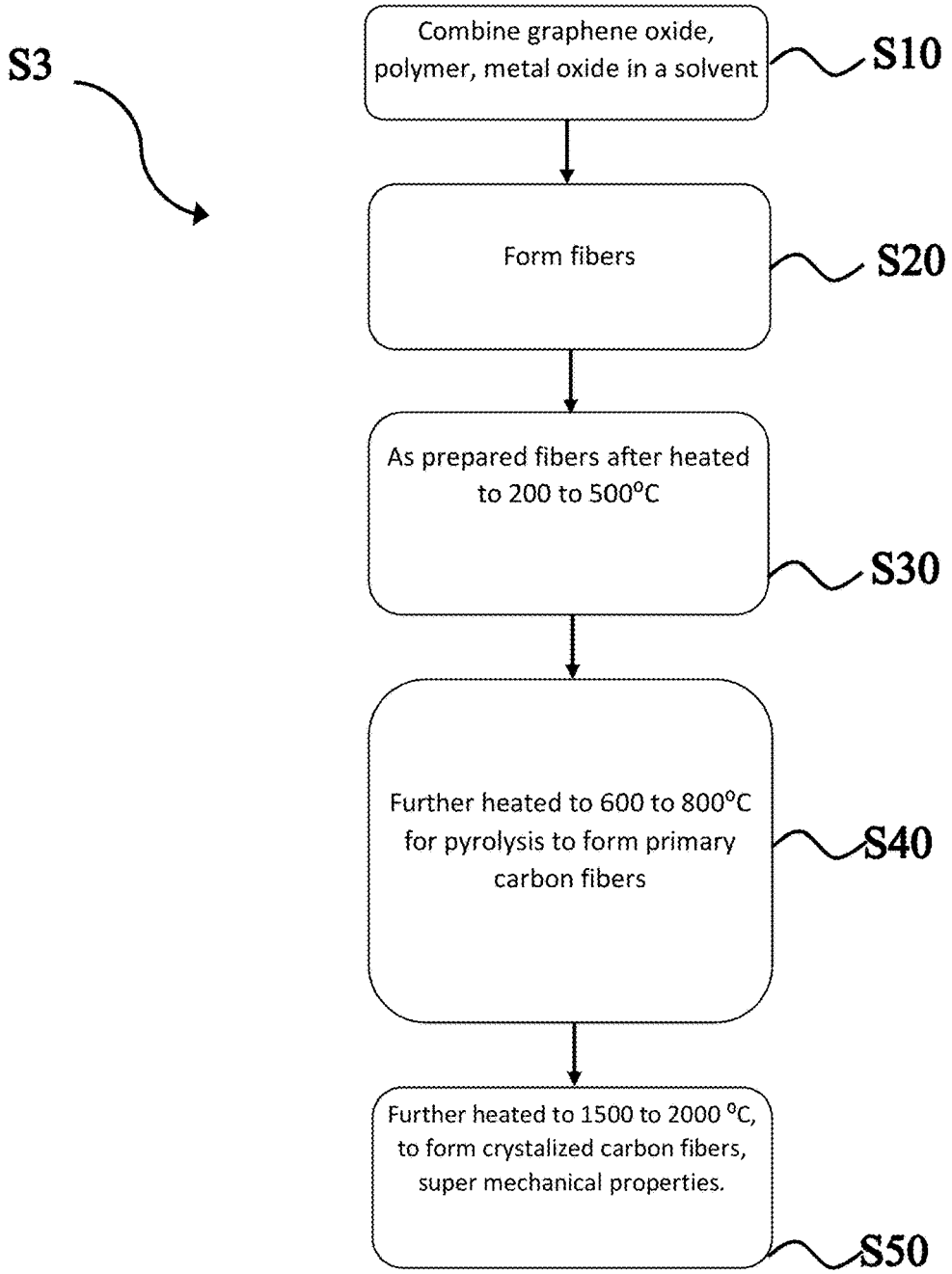
FIG. 3 is a flowchart showing yet another method of manufacturing graphene carbon fiber according to the present invention.

Referring to FIG. 3, yet another embodiment of an operational flowchart of the method of manufacturing graphene into carbon fiber according to the present invention. As shown in FIG. 3, the method of the present invention generally comprises the steps of mixing graphene oxide S10 with other components, forming the fibers via air-spray or electrospinning, dry spinning, or the like S20, applying a heat treatment between 200° C. to 500° C. S30, applying a further heat treatment between 600 to 900° C. for pyrolysis to form primary carbon fibers S40, and applying a further heat treatment heated to 1500 to 2000° C. S50 which results in a further refined and crystalized carbon fiber. In a preferred embodiment of the present invention the heating process heats the fibers up to 300° C. in air S30. In varying embodiments, fibers may be formed into products (such as pipes, panels, and the like) either before further processing steps, or after. After the initial heating the fibers, under inert gas condition, such as nitrogen, or argon, may be increased in temperature to 650° C. for pyrolysis of cellulose and create chemical bonding crosslinks of GO with cellulose-formed graphene layers S40; further more in a hydrogen environment, anneal the fibers to 1200° C. for 2 hours, and then increase to 2000° C. for two hours to ensure the perfection of crystallization of the graphitic carbon fibers S50. In various examples, the resultant fiber materials may be formed into products or components such as airplane parts, trucks, cars, and the like. Further, such fibers may be used in concrete or cement composite constructions, and may be used instead of or in addition to polymer fibers.

Figure 4:
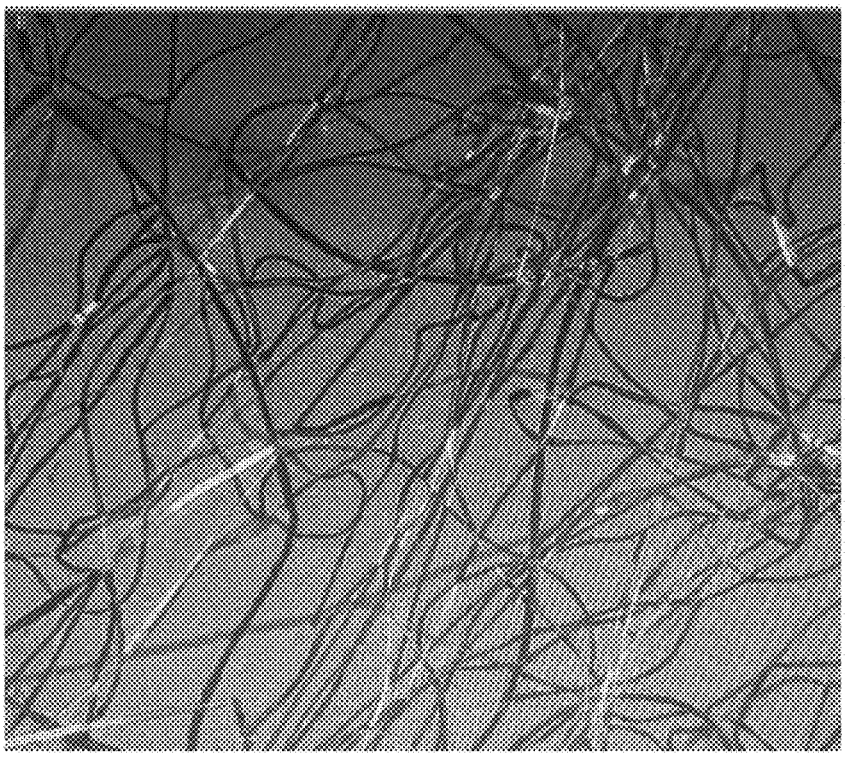
FIG. 4 is a view showing an embodiment of the carbon composite nanofibers obtained from the present invention.

FIG. 4 provides a preferred embodiment of the resulting carbon fiber created with the use of the method of manufacturing graphene into carbon fiber according to the present invention detailed in FIG. 1.

Figure 5:
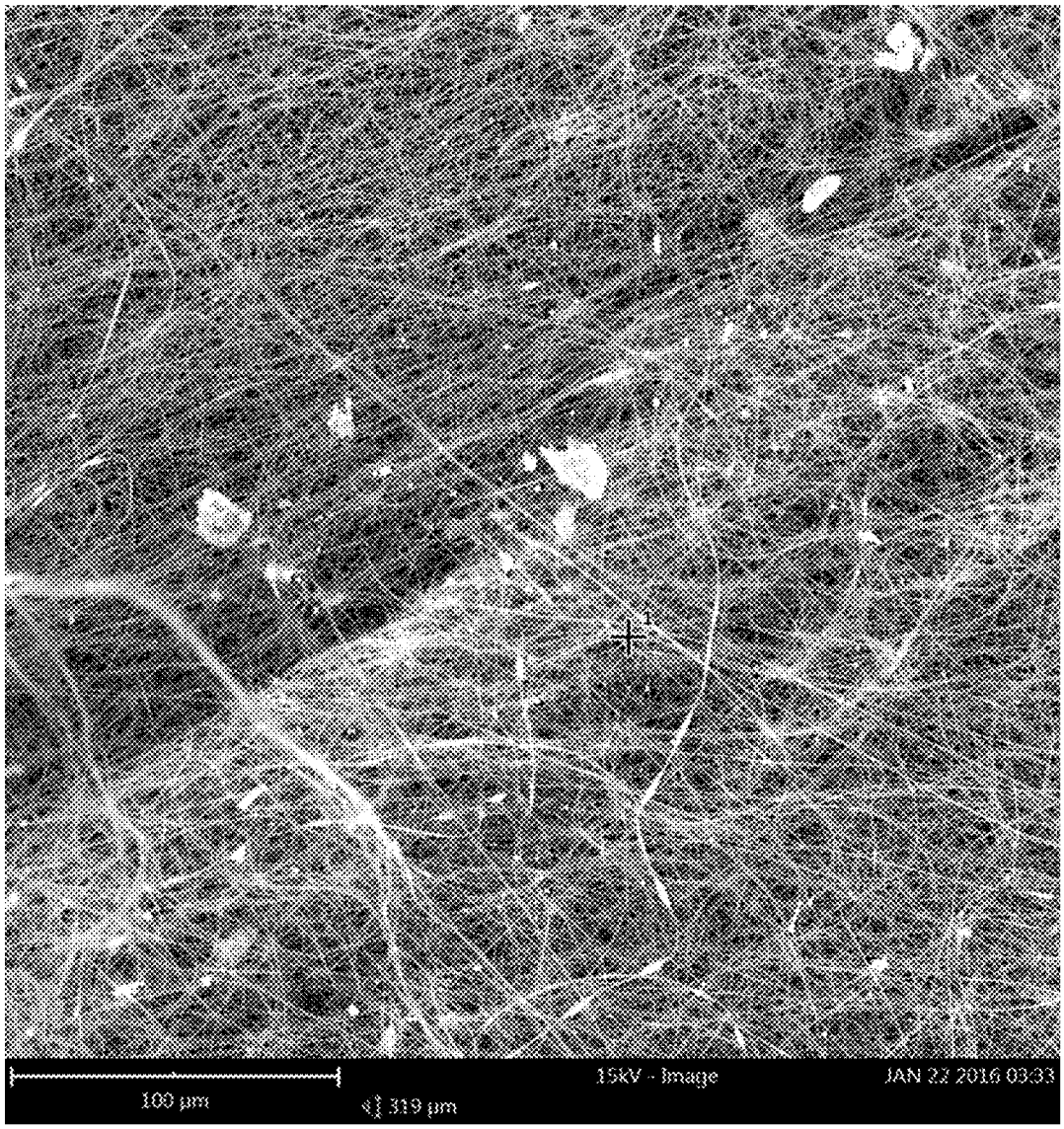
FIG. 5 is a view showing an embodiment of the carbon nanofiber composite obtained from the present invention prepared by the electrospinning method.

FIG. 5 provides a preferred embodiment of the resulting carbon fiber created with the use of the method of manufacturing graphene into carbon fiber according to the present invention detailed in FIG. 2.

In a preferred embodiment of the present invention the resulting carbon fibers may be used to create pipes and tubes that are resistant to corrosion and are capable of replacing common polyvinyl chloride (PVC) pipes as well as copper and lead based pipes. The resulting carbon fiber piping would have improved tensile strength, be able to endure increased temperature stress ranges, and have improved resistance to corrosion when compared to the pipes current found in use across the world. Another preferred embodiment would be the use of carbon fiber to make piping or tubing used to hold or transport drinking water.

EXAMPLE 1

Figure 6:
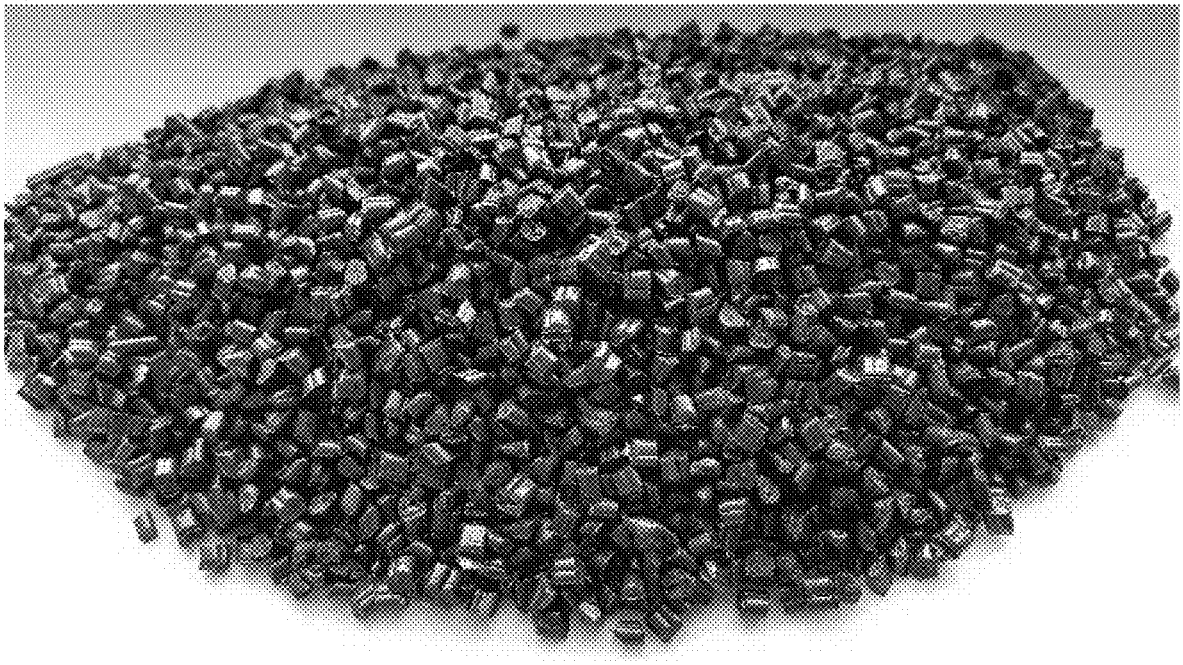
FIG. 6 provides a view of Graphene oxide Compounded with a low melting point polymer powder.
Figure 7:
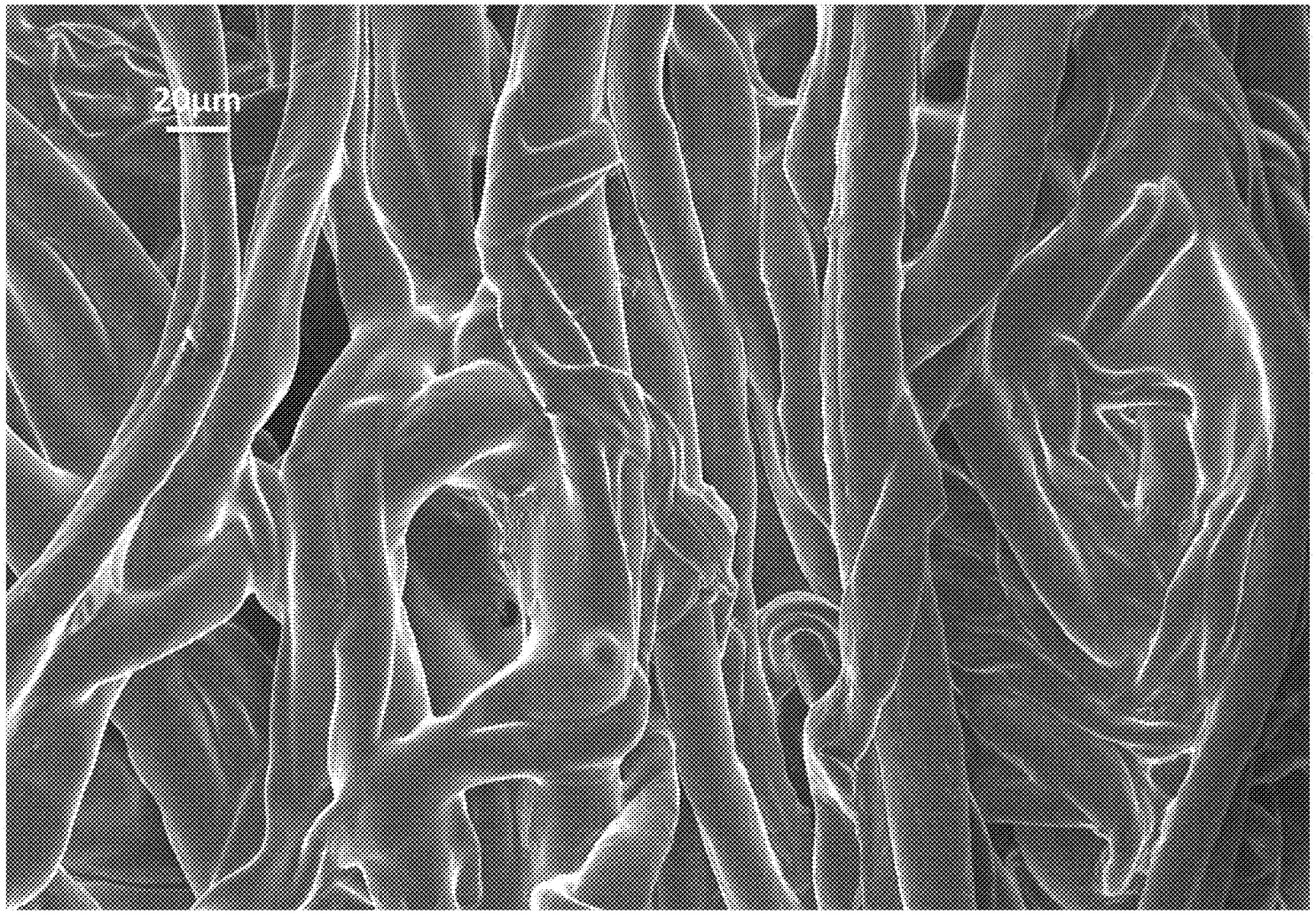
FIG. 7 provides a view of Melt-spun precursor fibers.

A cotton candy style spinning machine is used to melt a compound (such as that discussed herein) and spin it into precursor fibers. The compound was made by mixing over 30% (wt.) graphene oxide flakes in mass with a low melt point (<250° C.) polymer, such as candy powder, PLA, PVA, and other low melt point polymers listed herein, among others, in air. A trace of amount nickel (II) oxide (<5% in wt.) was added into the compound to function as Ni catalyst source for carbon fiber formation in post-treatment process. FIG. 6 provides a view of the compound melted, while FIG. 7 provides a view of an embodiment of the melt-spun fibers.

Figure 8:
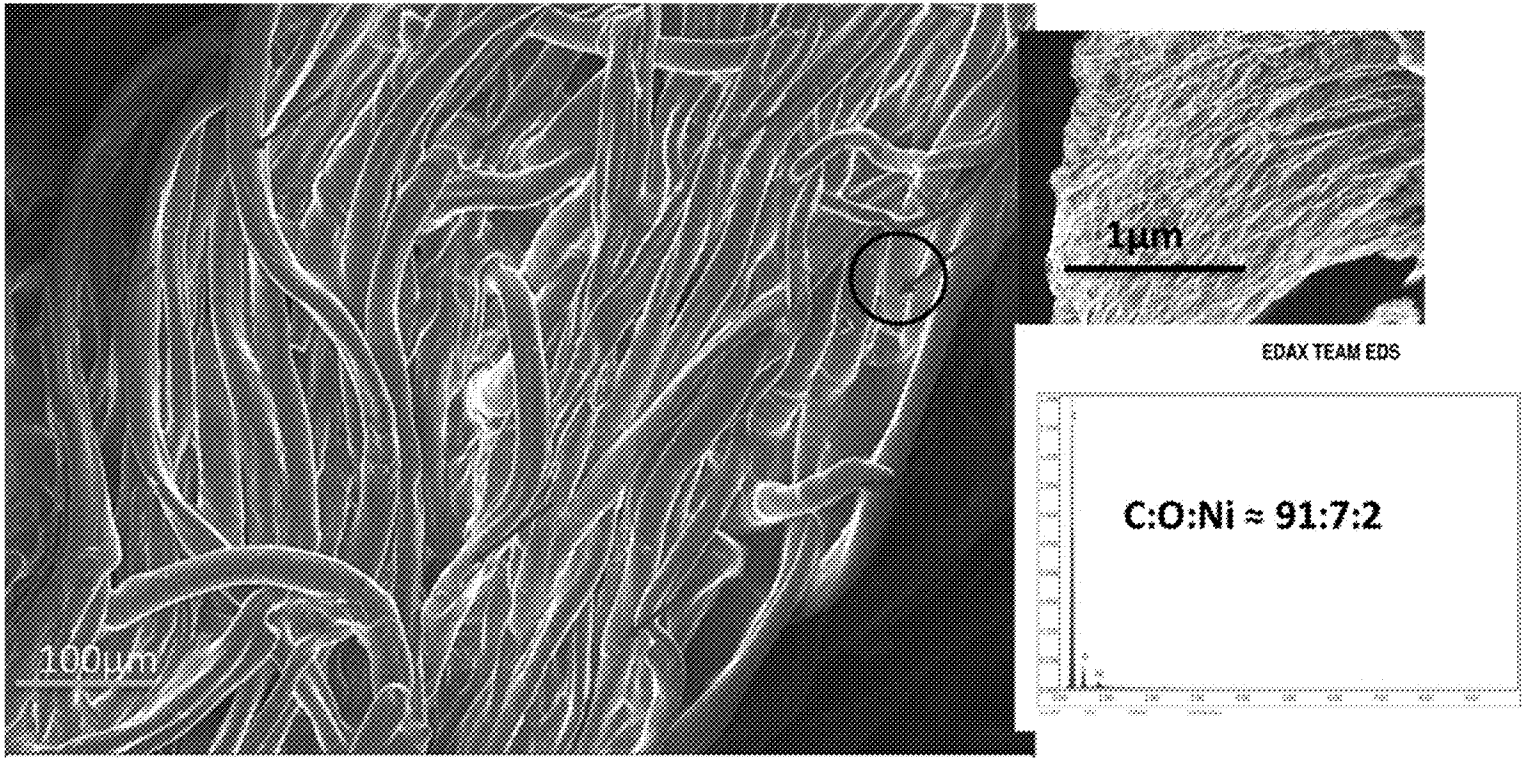
FIG. 8 provides a view of graphene carbon fiber from graphene oxide under the inducing of polymer templating.

The precursor fibers were pulled out to form bundle fibers (FIG. 8), then put into a tube furnace with process of oxidation in air, carbonization with flowing nitrogen, and then followed by additional formation of multilayer graphene on the fibers under gases flow of hydrogen and methane, then annealed to remove defects and to form graphitic crystals in nitrogen from a temperature range of room temperature to 1600° C., respectively. The product shows a tensile strength of 0.45 Mpa at first treatment of lower than 500° C., then increase to 1172 Mpa (>1.0 GPa) after annealing post treatment of 1600° C. under nitrogen for 4 hours. FIG. 8 provides a view of graphene carbon fiber in this invention prepared from graphene oxide under the inducing of polymer templating: arrows point out the multilayer graphene grown in the post-treatment of annealing in the gases flow of methane and hydrogen at higher temperature. Trace catalyst is within the carbon fibers as final product.

EXAMPLE 2

Figure 9:
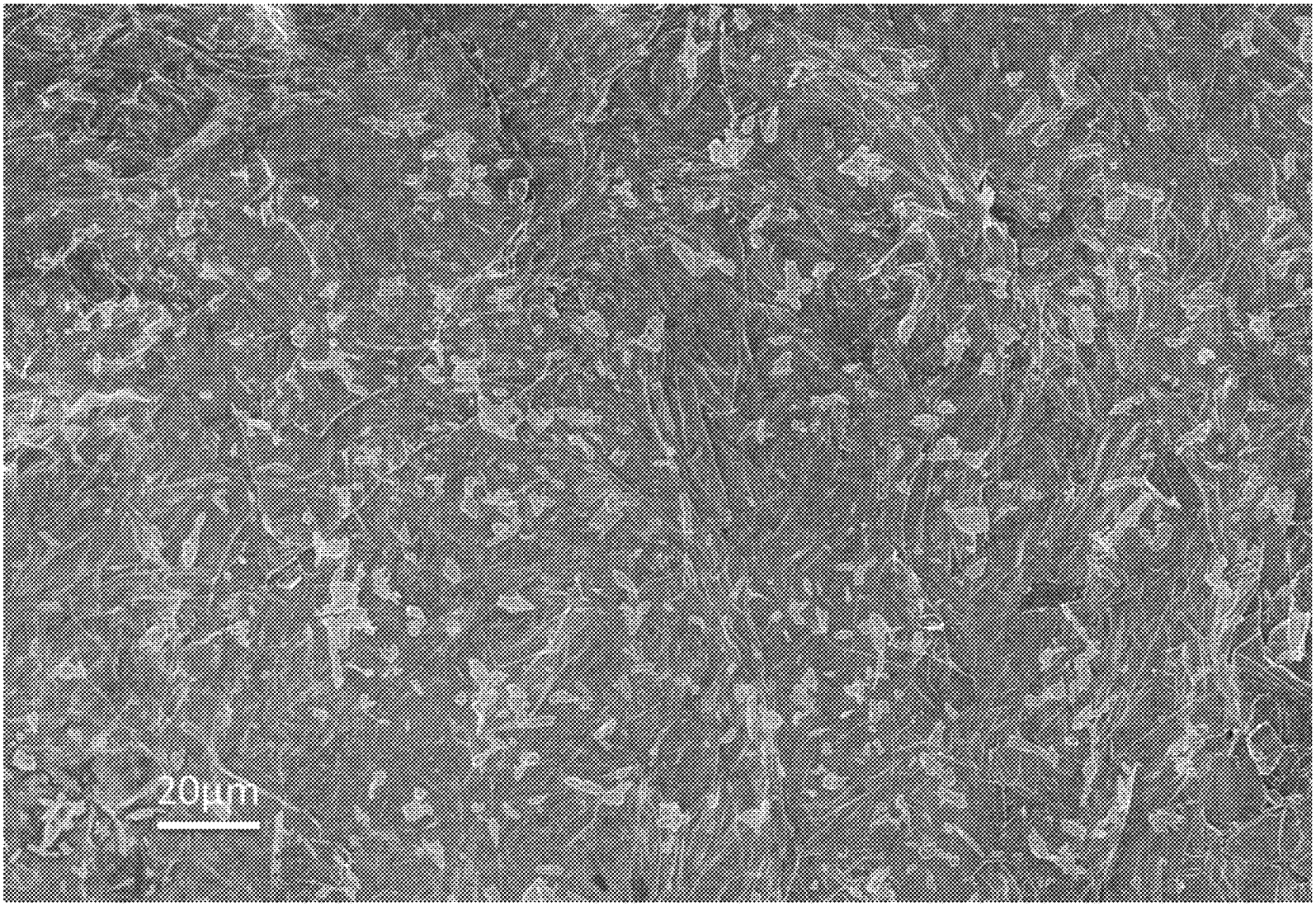
FIG. 9 provides a view of graphene oxide flakes dispersed uniformly by templating of nano cellulose.

A cellulose solution was prepared by dissolving nanocellulose powder into an aqueous solution of mixture of nickel (II) hydroxide with 1,3-diaminopropane. Then a heavy mass load of graphene oxide nanoflake powders are dispersed in the nano cellulose mixture solution to form a uniform graphene nanoflake suspension. FIG. 9 shows the SEM image of a drop of this suspension as dried film showing the graphene oxide flakes dispersed uniformly by templating of nano celluloses.

Figure 10:
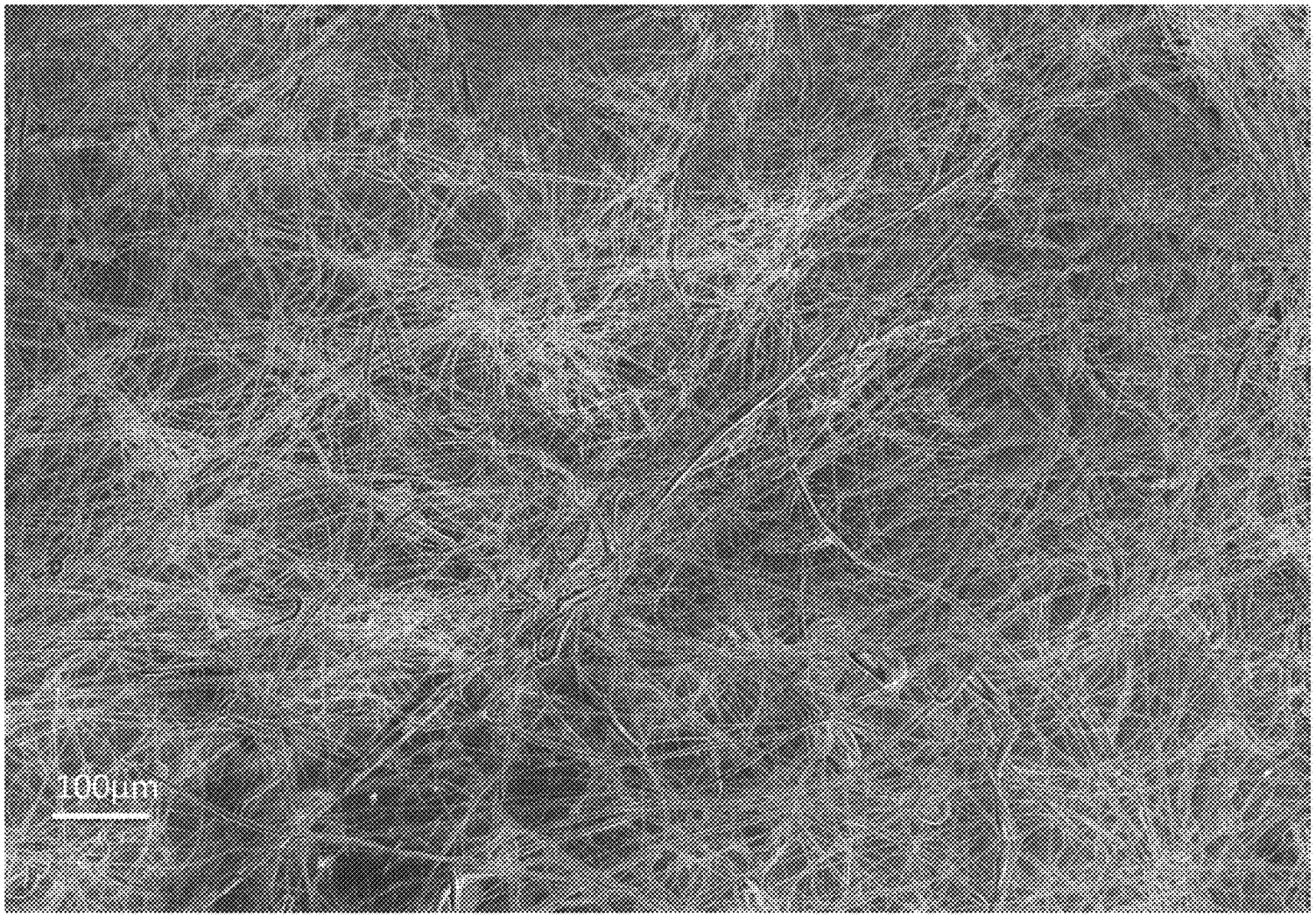
FIG. 10 provides a view of graphene-oxide/nano-cellulose fibers from solution spun in air.
Figure 11:
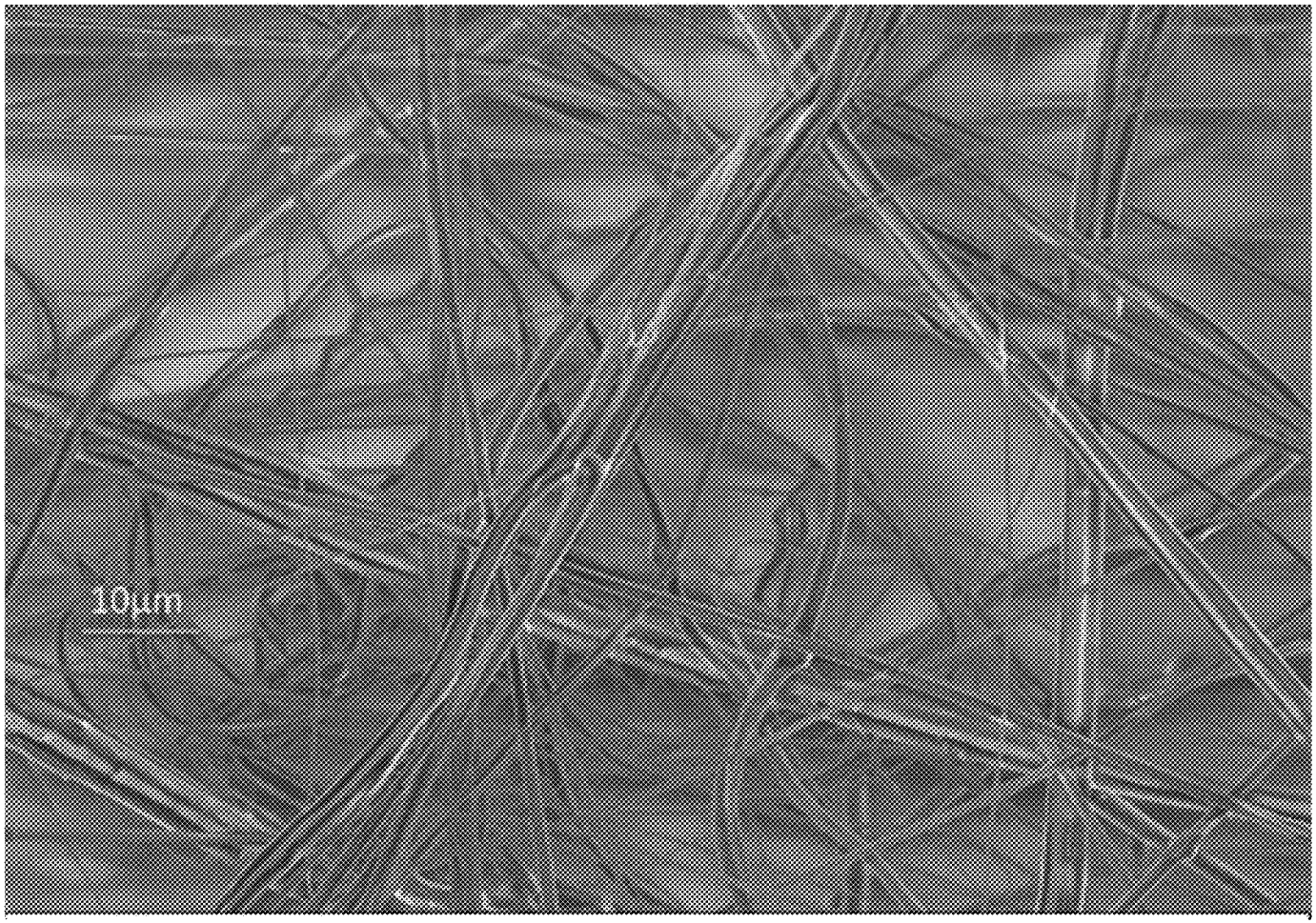
FIG. 11 provides a view of graphene-oxide/nano-cellulose fibers from solution spun in air.
Figure 12:
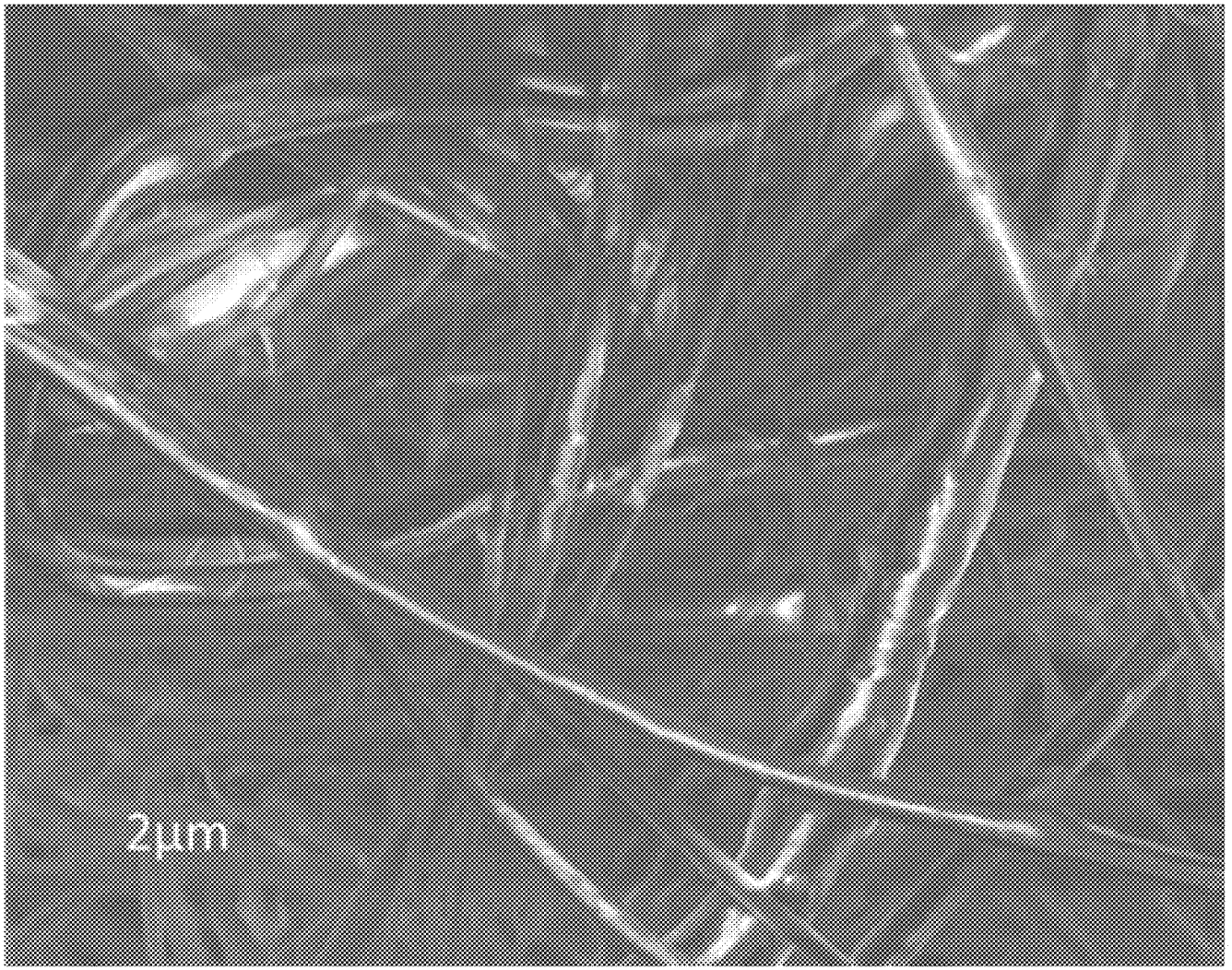
FIG. 12 provides a view of graphene-oxide/nano-cellulose fibers from solution spun in air.
Figure 13:
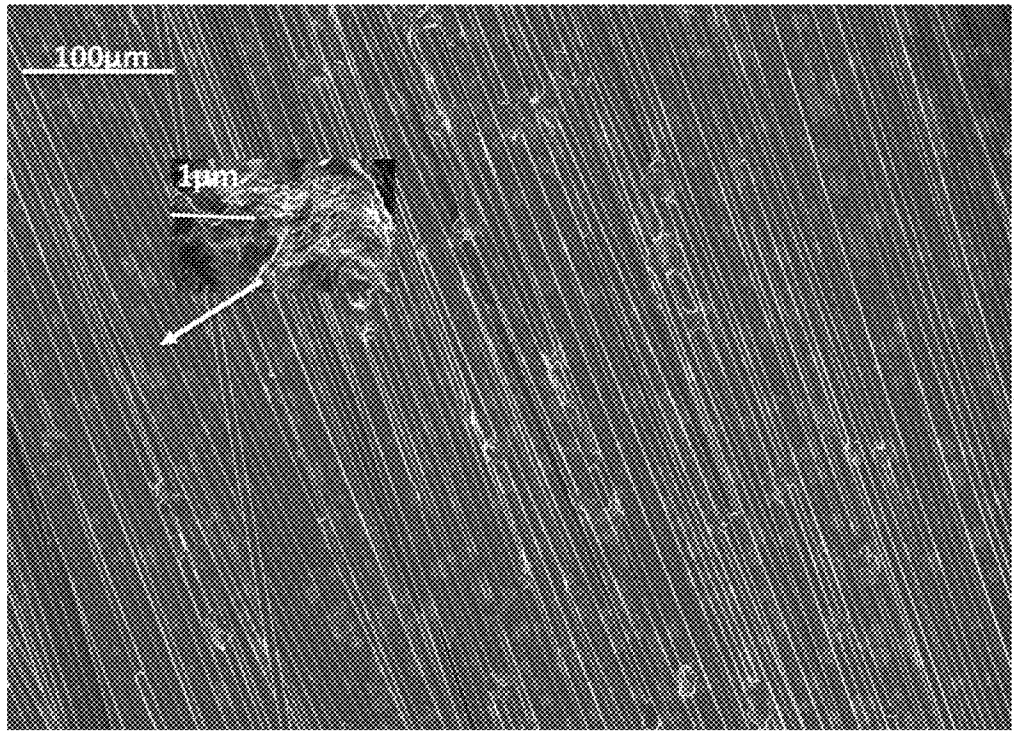
FIG. 13 provides a view of carbon fibers obtained from PAN-templated Graphene composite
Figure 13:
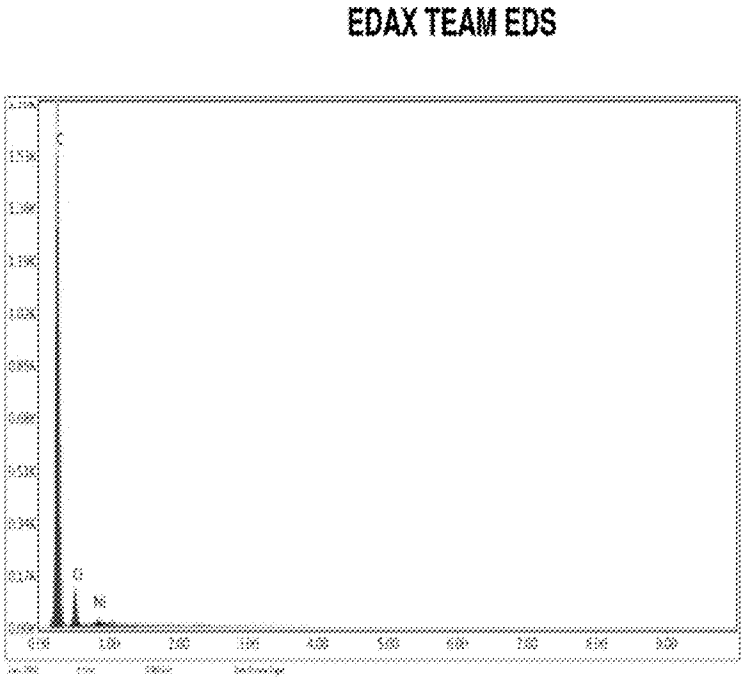

Solution precursor fibers were prepared by directly spinning the mixture in air (FIGS. 10-12: air-drying spun fibers). After similar treatment as Example 1, the final fiber obtained at lower than 600° C. is 625 Mpa, and after annealed at 1600° C., its shows a tensile strength of 1773 Mpa (>1.5 Gpa). As can be seen in FIGS. 10-11, Graphene-oxide/nanocellulose fibers are shown formed from solution spun in air.

EXAMPLE 3

Graphene oxide flakes were dispersed in the templating solution of diluted polyacrylonitrile (PAN) in dimethylformamide (DMF). Electrospinning was used to generate nanosized fibers (FIGS. 4 and 5), or solution drawing to form larger sized graphene oxide/PAN fibers (FIG. 11). Similar post-treatment as example 1 and 2 were performed.

The electro-spun fibers show a tensile strength of 2010 Mpa (>2 Gpa) after 1600° C. annealing, for example such as that described in example 1, while the drawn fibers when aligned (FIG. 11) gives tensile strength of 2586 Mpa (>2.5 Gpa) after the same post-treatment. The resulting carbon fibers obtained from the PAN-templated graphene composites can be seen in FIG. 11, having a composition of C:O:Ni≈92:7:1.

Further treatment the as-processed fibers from 1600° C. to 2000° C. should generate high performance carbon fibers that should have properties closed to conventional PAN fibers. In this invention, we prefer using lower temperature annealing to obtain practical carbon fibers with tensile strength between carbon nanotubes and conventional PAN carbon fibers to satisfy most general applications. This invention does not exclude the applications in aerospace such as space vehicles and airplanes if the invented carbon fibers satisfy the entire properties of those criterial requests.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A method of forming carbon fibers comprising the steps of:

mixing a quantity of graphene oxide in a solvent having a surfactant to disperse the quantity of graphene oxide;

adding a polymer to the solvent and graphene oxide to form a first mixture;

stirring the mixture to reach an approximately uniform viscosity;

adding a quantity of nano-cellulose fibers to the first mixture to form a second mixture, the quantity of nano-cellulose fibers acting as a templating material;

forming fibers from the second mixture of graphene oxide, solvent, polymer, and nano-cellulose fibers;

heating the formed fibers in air to a temperature between approximately 200-500 Celsius;

pyrolyzing the quantity of nano-cellulose by heating the formed fibers in an inert gas environment to approximately 600-900 Celsius; and annealing the pyrolyzed fibers in a hydrogen and methane environment.

2. The method of claim 1 wherein the step of forming fibers comprises one of wet-drawing plus hot air heating, drying spinning, melt-spinning or solution spinning, and electrical spinning.

3. The method of claim 1 wherein the pyrolyzing step heats the formed fibers in an inert gas environment to approximately 650 Celsius.

4. The method of claim 3 further comprising the steps of adding at least one of CuO, NiO, $ZrO_2$, $Fe_3O_4$, $Fe_2O_3$, $Co_2O_3$, MgO, $MnO_2$, ZnO, $TiO_2$, $Al_2O_3$, $SiO_2$, AgO, $SnO_2$, $Mo_2O_3$, $WO_3$, $Cr_2O_3$, trace lanthanum hafnate ($La_2Hf_2O_7$), $IrO_2$, metal nanoparticles or nanowires, such as Al, Mg, Ag, Au, Cu, Ni, Co, Zn, Fe, Sn, Ti, Cr, W, Mo, Pt, and Si nanowires to the mixture;

annealing the formed fibers in the hydrogen and methane gas environment to approximately 1200 Celsius for two hours in a first annealing step; and annealing the formed fibers in the hydrogen and methane gas environment to approximately 2000 Celsius for two hours in a second annealing step.

5. The method of claim 1 wherein the step of heating the formed fibers in air comprises heating the formed fibers to approximately 300 Celsius.

6. The method of claim 1, wherein the annealing step heats the pyrolyzed fibers to approximately 1500-2000 Celsius.

7. The method of claim 1 further comprising the step of adding at least one of CuO, NiO, $ZrO_2$, $Fe_3O_4$, $Fe_2O_3$, $Co_2O_3$, MgO, $MnO_2$, ZnO, $TiO_2$, $Al_2O_3$, $SiO_2$, AgO, $SnO_2$, $Mo_2O_3$, $WO_3$, $Cr_2O_3$, trace lanthanum hafnate ($La_2Hf_2O_7$), $Iro_2$, metal nanoparticles or nanowires, such as Al, Mg, Ag, Au, Cu, Ni, Co, Zn, Fe, Sn, Ti, Cr, W, Mo, Pt, and Si nanowires to the mixture.

8. The method of claim 1 wherein the polymer is at least one of polyacrylonitrile, polystyrene, components found in asphalt, epoxy, polycarbonate, celluloses, polyvinyl alcohol, polyurethane, polyvinyl chloride, polyethylene, polyethylene glycol, nylon, polydimethylsiloxane, and polyacrylamide.

9. The method of claim 1 wherein the solvent is at least one of water, an alcohol, acetone, a ketone, dimethyl formamide, ethylene glycol, and Dimethyl sulfoxide.

10. The method of claim 1 further comprising forming the formed fibers into a functional shape comprising a plurality of the formed fibers.

11. The method of claim 10 further comprising the step of applying a concrete layer to a surface of the functional shape.

12. The method of claim 10 wherein the functional shape is selected from the group consisting of a vehicle panel and a pipe.

13. The method of claim 1 further comprising the step of adding at least one of CuO, NiO, $ZrO_2$, $Fe_3O_4$, $Fe_2O_3$, $Co_2O_3$, MgO, $MnO_2$, ZnO, $TiO_2$, $Al_2O_3$, $SiO_2$, AgO, $SnO_2$, $Mo_2O_3$, $WO_3$, $Cr_2O_3$, trace lanthanum hafnate ($La_2Hf_2O_7$), $IrO_2$, metal nanoparticles or nanowires, such as Al, Mg, Ag, Au, Cu, Ni, Co, Zn, Fe, Sn, Ti, Cr, W, Mo, Pt, and Si nanowires to the mixture.

14. The method of claim 1 further comprising the step of adding at least one of CuO, NiO, $ZrO_2$, $Fe_3O_4$, $Fe_2O_3$, $Co_2O_3$, MgO, $Mn0_2$, ZnO, $TiO_2$, $Al_2O_3$, $SiO_2$, AgO, $SnO_2$, $Mo_2O_3$, $WO_3$, $Cr_2O_3$, trace lanthanum hafnate ($La_2Hf_2O_7$), $IrO_2$, metal nanoparticles or nanowires, such as Al, Mg, Ag, Au, Cu, Ni, Co, Zn, Fe, Sn, Ti, Cr, W, Mo, Pt, and Si nanowires to the mixture.

* * * * *